United States Patent [19]

Mas

[11] 4,054,502

[45] Oct. 18, 1977

[54] QUICK START ELECTROLYSIS APPARATUS

[75] Inventor: Louis Mas, Buc, France

[73] Assignee: Societe de Recherches Techniques et Industrielles, Buc, France

[21] Appl. No.: 653,522

[22] Filed: Jan. 29, 1976

[30] Foreign Application Priority Data

Feb. 3, 1975 France ..... 75.03250

[51] Int. Cl.[2] ..... C25B 15/02; C25B 1/02

[52] U.S. Cl. ..... 204/228; 204/129; 204/229; 204/230

[58] Field of Search ..... 204/228, 129, 229, 230, 204/DIG. 9

[56] References Cited

U.S. PATENT DOCUMENTS

| | | | |
|---|---|---|---|
| 3,063,929 | 11/1962 | Phelan | 204/228 |
| 3,870,616 | 3/1975 | Dempsey et al. | 204/230 |

FOREIGN PATENT DOCUMENTS

| | | | |
|---|---|---|---|
| 674,319 | 6/1952 | United Kingdom | 204/129 |
| 275,880 | 8/1927 | United Kingdom | 204/129 |

*Primary Examiner*—John H. Mack
*Assistant Examiner*—D. R. Valentine
*Attorney, Agent, or Firm*—Cushman, Darby & Cushman

[57] ABSTRACT

A quick-start electrolysis apparatus which is started up by means of an electrical supply circuit comprising regulating means for increasing the current intensity flowing through the apparatus in an exponential fashion as a function of time so that the ratio between the volume of gas and the volume of electrolyte is maintained constant.

3 Claims, 2 Drawing Figures

QUICK START ELECTROLYSIS APPARATUS

The invention relates to a quick-start electrolysis apparatus and a method of starting it, and in particular to such an electrolysis apparatus which is capable of being put into operation quickly at maximum power without requiring the use of nitrogen, and without the danger of one of the gases resulting from electrolysis being polluted to any serious degree by the other.

Electrolysis apparatus is made up of a stack of cells each of which is separated into two compartments by a diaphragm which is intended to separate electrolyte containing hydrogen bubbles from electrolyte containing oxygen bubbles. When the apparatus is in use, particularly when it is being started and stopped, great care is taken to prevent either of the gases from in any way mixing with or polluting the other, which would give rise to a risk of explosion. To this end, certain precautions are taken, particularly when starting up. Thus, in order to put known electrolysis apparatus into operation, it is pressurised to 5 bars with nitrogen and a current equal to 1/6 of the rated current is then applied for the time required for the pressure to rise to approximately 15 bars, after which the rated current is applied. This procedure has certain drawbacks, of which the principal one is that pressure is raised at a very low current intensity, which means a rather long starting-up period.

In addition, it is known that in an apparatus for electrolysing water which operates under pressure, the impurity of the gases is inversely proportional to current density and when the apparatus is run for a fairly long period at a low current density there is a danger of reaching purity levels which may be above the threshold of explosibility, which is why it is necessary to use nitrogen.

Finally, the means for regulating pressure and current level operate unsatisfactorily when the gas output is six times lower than normal.

As a matter of fact if an electrolysis apparatus is to operate satisfactorily under pressure it is necessary that the volume occupied by the gas bubbles in the cell should at no time exceed the volume of the electrolyte. This means that, whatever the pressure, the volume of gas output on the hydrogen side should be less than half the output of the catholyte side. This value is so fixed for safety reasons. Tests have in fact been carried out with gas output on the hydrogen side equal to the catholyte output and with the starting-up process taking place under satisfactory conditions, but the heat dissipation was then considerable and because of this, it seems preferable to use current levels such that the gas output on the hydrogen side is less than the value quoted above.

Two conflicting requirements thus have to be met; since on the one hand, current intensity needs to be increased to reduce pollution and, on the other hand, the current intensity needs to be cut down in order not to increase the volume of gas. To reconcile these requirements, it is necessary to raise the pressure as quickly as possible. This rise in pressure is inversely proportional to the ratio of the volume of gas in the gas separator over the quantity of hydrogen drawn off. It is difficult to change the volume of the gas separator and so, in order to reduce this ratio, in the final analysis it is best to increase hydrogen output to the maximum, that is to say to increase the current intensity, but without at any time exceeding the maximum permitted figure for the ratio between the volume of the gases and the volume of the electrolyte within the cells.

An object of the present invention is to avoid these drawbacks and consists in an electrolysis apparatus comprising means for continuously adjusting the current to its optimum level for the existing pressure.

In accordance with an important feature of the invention the electrolysis apparatus is started up by increasing current intensity in an exponential fashion. The invention, more particularly relate to an electrolysis apparatus comprising an electrolysis apparatus made of a stack of cells, each of which being separated into two compartments by a diaphragm which is intended to separate electrolyte containing hydrogen bubbles from electrolyte containing oxygen bubbles; put into operation by an electrical supply circuit, said supply circuit comprising means for increasing the current intensity in an exponential fashion as a function of time.

The invention will be better understood and the foregoing and other object features and advantages will be more clearly apparent from the following description which is given solely by way of example and which refers to the accompanying schematic drawings in which.

Figure 1:
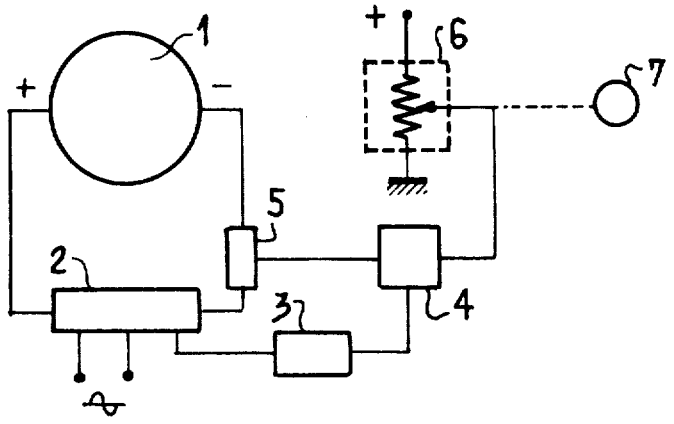
FIG. 1, is a diagram of an electrolysis apparatus according to the invention.

FIG. 1 shows an electrolysis apparatus 1 which is supplied by a bridge of thyristors 2 whose triggers are operated by a control circuit 3. This circuit receives pulses from a comparator 4, which pulses are emitted as the result of a comparison between a voltage proportional to the current intensity flowing through the apparatus, which is supplied by an ammeter 5, and a voltage coming from an exponential potentiometer 6 which is supplied by any suitable constant source. This potentiometer is controlled by a timer 7 or a clock. FIG. 1 more particularly shows an electrolysis apparatus which is made up of a stack of cells 1, each of which is separated into two compartments by a diaphragm which is intended to separate electrolyte containing hydrogen bubbles from electrolyte containing oxygen bubbles. This apparatus is put into operation by means of an electrical supply circuit which, in an example of embodiment, comprises means for starting up said apparatus by increasing current intensity in an exponential fashion. The supply circuit comprises a rectifier system which is, for example the bridge of thyristors 2 having two inputs connected to an alternating source and whose triggers are operated by means of a control input connected to an out put of the control circuit 3. The bridge of thyristors 2 has a first and a second outputs respectively connected to a negative terminal and to a positive terminal of the stack of cells 1. The current intensity flowing through the apparatus is measured by means of the ammeter 5 having an output connected to a first input of the comparator 4. Means for controlling exponentially the current passing through the apparatus, for example, the exponential potentiometer 6 are supplied by any suitable constant source. This potentiometer 6 is controlled by the timer or clock 7 and has an output connected to a second input of the comparator 4 while a output of said comparator 4 is connected to an input of the control circuit 3. The bridge of thyristors 2 supplies a direct current to the stack of cells from the alternating source. It is operated by the control circuit 3 which receives pulses from the comparator 4. As related below the pulses are emitted as the result of comparison between a first voltage proportional to the current intensity flowing through the apparatus which is supplied by the ammeter 5 and a voltage coming from the exponential potentiometer 6 so that the ratio between the volume of gas and the volume of the electrolyte is maintained constant. The initial intensity level and the value of the exponent determine the initial settings of the control circuits and the repetition rate set by the timer or clock. The current intensity at start-up and the value of the exponent depend on the constructional characteristic of the electrolysis apparatus as related below.

The electrolyte is supplied to the cells at a constant rate. Taking rates of flow as a basis, the above ratio between the volumes may be expressed in the following way, where $q$ is the volume of gas output from a cell and D is the electrolyte output, $q$ is made smaller than D and in general $$q = D/2 \tag{1}$$

to prevent any excess heating. The volume output of gases is proportional to current intensity and inversely proportional to pressure and this may be written as:

$$q = K\frac{I(t)}{P} = \frac{D}{2} \tag{2}$$

$I(t)$ being the current intensity at the time in question and $K$ being a coefficient.

In addition, the pressure P prevailing within the electrolysis apparatus and its various circuits is equal to the initial pressure $Po$ before starting, plus (temperature being assumed to be constant) an amount proportional to the amount of gas produced by the electrolysis, which in turn is a direct function of the amount of electricity passing through the apparatus. This may be written as:

$$P = Po + L\int_o^t I(t)\,dt. \tag{3}$$

$L$ being a constant coefficient. From formulae (1) and (3) is obtained:

$$P = \frac{2\,K\,I(t)}{D} = Po + L\int_o^t I(t)\,dt$$

After differentiation, this gives:

$$\frac{2\,K}{D}\;\frac{dI(t)}{dt} = L\,I(t)$$

which in turn gives: $I = M.e^{NT}$; $M$ and $N$ being coefficients.

In other word, if the current intensity is exponentially increased according to the present invention, the ratio between the volume of gas and the volume of electrolyte is constant.

Figure 2:
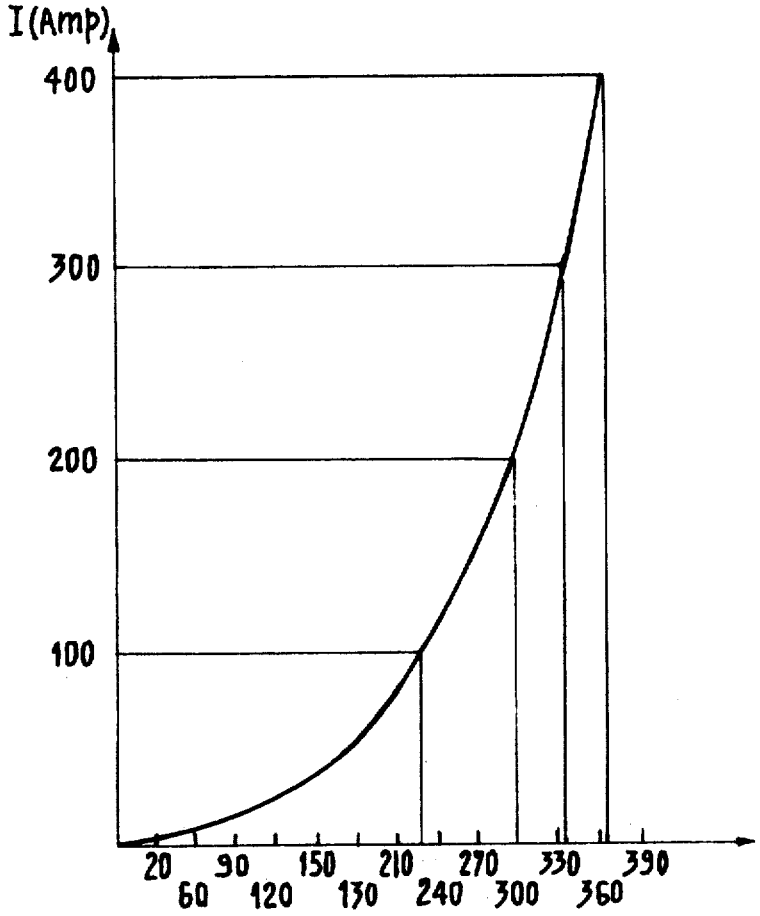
FIG. 2, is a graph for the rise in current intensity.

As shown in FIG. 2, in an apparatus which produces 10 cubic meters of hydrogen STP per hour and which functions at 40 bars in normal operation, the current intensity was increased exponentially as a function of time in the manner indicated by the graph. Under these conditions the pressure rose from atmospheric to 40 bars in seven minutes whilst the rise from 5 bars to 40 bars took place in ½ minutes.

It can be seen that the present method allows a start to be made directly from atmospheric pressure and that there is no necessity to use nitrogen to give a starting pressure of a few bars.

In the course of these tests the purity of the hydrogen obtained was always better than 98%.

What is claimed is:

1. Electrolysis apparatus made of a stack of cells, each of which is separated into two compartments by a diaphragm which is intended to separate electrolyte containing hydrogen bubbles from electrolyte containing oxygen bubbles; put into operation by an electrical supply circuit, said supply circuit comprising means for starting up said apparatus by maintaining constant, the ratio between the volume of gas and the volume of electrolyte, said means increasing the current intensity in an exponential fashion as a function of time.

2. Electrolysis apparatus as claimed in claim 1 wherein said electrical supply circuit comprises a rectifier system having two inputs connected to alternating source and a first and a second outputs respectively connected to a first negative terminal and to a second positive terminal of said stack, means for measuring the current intensity flowing through said apparatus, said means having an output connected to a first input of a comparator; an exponential potentiometer supplied by a constant source and controlled by a clock, said potentiometer having an output connected to a second input of said comparator, said comparator having an output connected to an input of a control circuit having an output connected to a control input of said rectifier system.

3. Electrolysis apparatus as claimed in claim 2 wherein said rectifier system is a bridge of thyristors supplying to said stack a direct current from said alternating source, said bridge being operated by said control circuit receiving pulses from said comparator, said pulses being emitted as the result of a comparison between a first voltage proportional to said current intensity, measured by an ammeter, and a second voltage coming from said exponential potentiometer; the ratio between the volume of gas and the volume of electrolyte being constant.

* * * * *